US008722595B2

(12) United States Patent
Kamano et al.

(10) Patent No.: US 8,722,595 B2
(45) Date of Patent: May 13, 2014

(54) LUBRICATING OIL COMPOSITIONS

(75) Inventors: Hideki Kamano, Ichihara (JP); Junichi Yagi, Chiba (JP); Hideto Kamimura, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 13/123,107

(22) PCT Filed: Sep. 18, 2009

(86) PCT No.: PCT/JP2009/066415
§ 371 (c)(1),
(2), (4) Date: Jun. 23, 2011

(87) PCT Pub. No.: WO2010/041551
PCT Pub. Date: Apr. 15, 2010

(65) Prior Publication Data

US 2011/0239972 A1 Oct. 6, 2011

(30) Foreign Application Priority Data

Oct. 9, 2008 (JP) ..... 2008-263146

(51) Int. Cl.
*C10M 141/10* (2006.01)
*C07F 9/6571* (2006.01)
*C10M 133/12* (2006.01)
*C07F 9/09* (2006.01)

(52) U.S. Cl.
USPC ..... 508/421; 508/422; 508/563; 558/85; 558/95

(58) Field of Classification Search
CPC ..... C10M 2203/1006; C10M 2203/1025; C10M 2215/064; C10M 2223/049; C08K 5/527; C08K 5/5317
USPC ..... 508/200, 422, 563, 421; 123/1 A; 558/85, 95
See application file for complete search history.

(56) References Cited

U.S. PATENT DOCUMENTS

| | | | |
|---|---|---|---|
| 5,889,095 | A | 3/1999 | Inui et al. |
| 6,172,014 | B1 | 1/2001 | Meyers |
| 6,465,548 | B1 | 10/2002 | Inoue et al. |
| 2009/0186785 | A1 | 7/2009 | Kamimura |

FOREIGN PATENT DOCUMENTS

| | | |
|---|---|---|
| JP | 10 273494 | 10/1998 |
| JP | 11-35962 | 2/1999 |
| JP | 2001 261968 | 9/2001 |
| JP | 2005-239897 | 9/2005 |

OTHER PUBLICATIONS

International Search Report Issued Nov. 17, 2009 in PCT/JP09/066415 filed Sep. 18, 2009.
European Office Action datedJan. 9, 2013 as received in the corresponding European Patent No. 09 819 086.1-2104.

*Primary Examiner* — Vishal Vasisth
(74) *Attorney, Agent, or Firm* — Oblon, Spivak, McClelland, Maier & Neustadt, L.L.P.

(57) ABSTRACT

The present invention provides a lubricating oil composition capable of achieving a lubricating property, a thermal stability, an oxidation stability, an anti-discoloring property and an anti-varnishing performance with a higher level by compounding a phosphorus compound having a specific structure in a base oil, as well as a lubricating oil composition for internal combustion engines which is excellent in wear resistance, high-temperature detergency and base number retention property although it has a low phosphorus content, a low sulfur content and a low sulfated ash content.

15 Claims, No Drawings

LUBRICATING OIL COMPOSITIONS

CROSS-REFERENCE TO RELATED APPLICATIONS

This application is a National Stage of PCT/JP09/066415 filed Sep. 18, 2009 and claims the benefit of JP 2008-263146 filed Oct. 9, 2008.

TECHNICAL FIELD

The present invention relates to lubricating oil compositions which are used in the applications such as gas compressors and internal combustion engines.

BACKGROUND ART

Lubricating oils have been generally used in various machines and apparatuses. For example, the lubricating oils have been used in gas compressors in which air or a refrigerant is compressed. The gas compressors are classified into a volume type and a turbo type according to their working principle for increasing a gas pressure. The volume type compressors are further classified into reciprocating compressors and rotary compressors.

The rotary compressors have been extensively used in view of saving of resources, measures for reduction of noises and vibrations, working efficiency, etc., as compared to the conventional reciprocating compressors. On the other hand, the rotary compressors are used under more severe lubricating conditions in which the lubricating oils must be brought into contact with high-temperature or high-pressure air or gases, as compared to the reciprocating compressors. Therefore, there is a demand for compressor oils for the rotary compressors which have a high thermal stability and a high oxidation stability.

There is a recent tendency that the rotary compressors are further downsized, and more frequently operated under poor ambient environmental conditions, e.g., in an atmosphere of an oxidative gas such as $SO_x$ and $NO_x$ or in a cutting oil mist atmosphere. In such a case, the lubricating oils suffer from occurrence of varnishing which tends to cause deposition of the varnishing on an inside of the compressors or clogging of a filter therein for a very short period of time, resulting in malfunction of the compressors.

On the other hand, a phenol-based antioxidant (di-t-butyl-p-cresol) which has been generally extensively used in the lubricating oils is likely to be volatilized and tends to suffer from considerable degree of discoloration. Therefore, the use of such a phenol-based antioxidant is not fully desirable from the viewpoints of a durability of the lubricating oils as well as suppression of discoloration of the oils. In addition, the phenol-based antioxidant or an amine-based antioxidant is insufficient in friction characteristics (such as anti-seizing property and wear resistance) by itself. Therefore, a friction controller containing sulfur/phosphorus having poor heat resistance and oxidation stability must be used in combination with the above antioxidant in the lubricating oils in order to improve a lubricating property thereof.

Under these circumstances, there is a demand for lubricating oils which are suitably used in machines or apparatuses operated under severe conditions such as gas compressors, excellent in heat resistance and oxidation stability, and hardly suffer from discoloration or occurrence of varnishing. For example, Patent Document 1 discloses a lubricating oil composition in which a phosphorus-containing phenol-based antioxidant, a phosphorus-free phenol-based antioxidant and an amine-based antioxidant are used in combination with each other. Patent Document 2 discloses a lubricating oil composition in which phenyl-α-naphthyl amine, p,p'-dialkyl diphenyl amine and a phosphorus-based extreme-pressure additive are used in combination with each other. Patent Document 3 discloses a lubricating oil composition in which a specific amine-based antioxidant and a phosphorus-containing phenol-based antioxidant are used in combination with each other.

On the other hand, in lubricating oils for internal combustion engines such as gasoline engines, diesel engines and gas engines, zinc dithiophosphate (Zn-DTP) has been used as both of an anti-wear agent and an antioxidant for a long time, and is also presently considered to be an important essential additive for the lubricating oils for internal combustion engines.

However, since the zinc dithiophosphate contains a large amount of a phosphorus component and a sulfur component in addition to a metal component (zinc) in a molecule thereof, sulfuric acid or phosphoric acid tends to be generated from the zinc dithiophosphate when decomposed. For this reason, the zinc dithiophosphate tends to exhaust a basic compound contained in engine oils and promote degradation of the lubricating oils, which tends to result in extremely shortened oil replacement intervals (this phenomenon means that a so-called base number retention property of the oils is insufficient). In addition, the zinc dithiophosphate tends to generate a varnishing under high-temperature conditions and therefore cause problems such as deterioration in cleaning property of an inside of the engine.

Under such circumstances, it has been demanded to develop an anti-wear additive which can be used in the lubricating oils for internal combustion engines in place of the zinc dithiophosphate.

In engines for current automobiles, an oxidation catalyst, a three way catalyst, an $NO_x$ occlusion type reducing catalyst, a diesel particulate filter (DPF), etc., have been used to purify exhaust gases emitted therefrom. It is known that these catalysts used for purification of exhaust gases tend to be adversely affected by metal components, phosphorus components and sulfur components contained in the engine oils. Therefore, it has been required that these components are reduced to prevent deterioration of the catalysts.

In consequence, there is an intense demand for lubricating oils for internal combustion engines which are excellent in properties basically required for lubricating oils for internal combustion engines (such as wear resistance, detergency and base number retention property) although they have a low metal content (i.e., a low sulfated ash content), a low phosphorus content and further a low sulfur content.

To solve the above problems, there have been conventionally proposed various additives for lubricating oils and various lubricating oil compositions. For example, Patent Document 1 has proposed the lubricating oil composition containing a specific phosphorus-containing phenol-based antioxidant. However, such a phosphorus-containing phenol-based antioxidant tends to be unsatisfactory in dissolvability in a base oil and therefore must be further improved to solve the above problems.

Patent Document 1:JP-A 11-35962
Patent Document 2: JP-A 2005-239897
Patent Document 3: JP-A 2007-161773

DISCLOSURE OF THE INVENTION

Problems to be Solved by the Invention

Under the above-mentioned circumstances, an object of the present invention is to provide a lubricating oil composition capable of achieving a lubricating property, a thermal stability, an oxidation stability, an anti-discoloring property and an anti-varnishing performance with a higher level. Also, another object of the present invention is to provide a lubricating oil composition, in particular, for internal combustion engines, which is excellent in wear resistance, high-temperature detergency and a base number retention property although it has a low phosphorus content, a low sulfur content and a low metal content (low sulfated ash content).

Means for Solving the Problems

As a result of intense and extensive researches for developing lubricating oil compositions having the above desirable properties, the present inventors have found that the above objects can be achieved by a lubricating oil composition in which a specific phosphorus compound is compounded. The present invention has been accomplished on the basis of the finding.

Thus, the present invention relates to the following aspects:

[1] A lubricating oil composition including a base oil and a phosphorus compound having a structure represented by the following general formula (I):

(I)

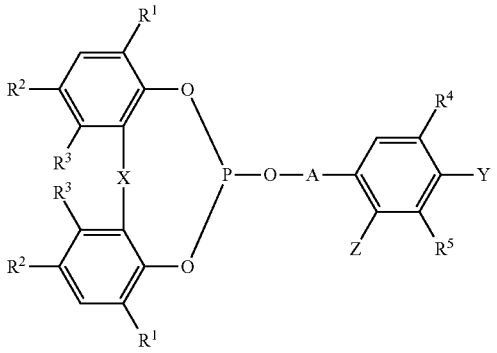

wherein $R^1$, $R^2$, $R^4$ and $R^5$ are each independently one group selected from the group consisting of a hydrogen atom, an alkyl group having 1 to 8 carbon atoms, a cycloalkyl group having 5 to 8 carbon atoms, an alkylcycloalkyl group having 6 to 12 carbon atoms, an aralkyl group having 7 to 12 carbon atoms and a phenyl group; $R^3$ is a hydrogen atom or an alkyl group having 1 to 8 carbon atoms; X is one group selected from the group consisting of a simple bond, a sulfur atom and a —$CHR^6$— group (wherein $R^6$ is one group selected from the group consisting of a hydrogen atom, an alkyl group having 1 to 8 carbon atoms and a cycloalkyl group having 5 to 8 carbon atoms); A is an alkylene group having 2 to 8 carbon atoms or a *—$COR^7$— group (wherein $R^7$ is a simple bond or an alkylene group having 1 to 8 carbon atoms, and the symbol (*) indicates a side on which the group is bonded to oxygen); and either one of Y and Z is one group selected from the group consisting of a hydroxyl group, an alkoxy group having 1 to 8 carbon atoms and an aralkyloxy group having 7 to 12 carbon atoms, and the other of Y and Z is a hydrogen atom or an alkyl group having 1 to 8 carbon atoms.

[2] The lubricating oil composition as described in the above aspect [1], further including at least one additive selected from the group consisting of an antioxidant, an ashless dispersant, a metallic detergent, a friction modifier, an extreme-pressure additive, a rust inhibitor, a viscosity index improver, a pour point depressant, a metal deactivator, a defoaming agent, a demulsifier and a colorant.

[3] The lubricating oil composition as described in the above aspect [2], wherein the antioxidant is an amine-based antioxidant.

[4] The lubricating oil composition as described in any one of the above aspects [1] to [3], wherein the composition has a phosphorus content of 0.12% by mass or less and a sulfated ash content of 1.2% by mass or less on the basis of an amount of the composition.

[5] The lubricating oil composition as described in any one of the above aspects [1] to [4], wherein the base oil has a % $C_A$ value of 10 or less as measured by ring analysis, a sulfur content of 300 ppm by mass or less and a viscosity index of 70 or more.

[6] The lubricating oil composition as described in any one of the above aspects [1] to [5], wherein the composition is used for gas compressors.

[7] The lubricating oil composition as described in any one of the above aspects [1] to [5], wherein the composition is used for internal combustion engines.

Effect of the Invention

In accordance with the present invention, there is provided a lubricating oil composition capable of achieving a lubricating property, a thermal stability, an oxidation stability, an anti-discoloring property and an anti-varnishing performance with a higher level. Also, there is provided a lubricating oil composition for internal combustion engines which can exhibit more excellent properties without compounding thereto zinc dithiophosphate which has been conventionally used as an essential additive therefor.

BEST MODE FOR CARRYING OUT THE INVENTION

The present invention relates to a lubricating oil composition prepared by compounding a phosphorus compound represented by the above general formula (I) in a base oil (hereinafter occasionally referred to merely as a "composition").

The base oil used in the present invention is not particularly limited, and may be appropriately selected from optional mineral oils and synthetic oils conventionally used as a base oil for lubricating oils.

Examples of the mineral oils include purified mineral oils produced by subjecting a reduced crude obtained by atmospheric distillation of a crude oil to distillation under reduced pressure to obtain a lubricating oil fraction and then subjecting the resulting lubricating oil fraction to one or more treatments selected from solvent deasphalting, solvent extraction, hydro-cracking, solvent dewaxing, contact dewaxing and hydrogenation refining, mineral oils produced by isomerizing waxes, GTL WAX, or the like.

Examples of the synthetic oils include polybutene, polyolefins [α-olefin homopolymers or copolymers (such as, for example, ethylene-α-olefin copolymers)], various esters (such as, for example, polyol esters, dibasic acid esters and phosphoric acid esters), various ethers (such as, for example, polyphenyl ether), polyglycols, alkyl benzenes, alkyl naphthalenes, polyoxyalkylene glycols, neopentyl glycol, silicone oils, trimethylol propane, pentaerythritol, and hindered esters. Among these synthetic oils, especially preferred are polyolefins and polyol esters.

In the present invention, as the base oil, the above mineral oils may be used alone or in combination of any two or more thereof. Also, the above synthetic oils may be used alone or in combination of any two or more thereof. Further, one or more kinds of mineral oils may be used in combination with one or more kinds of synthetic oils.

The viscosity of the base oil is not particularly limited. The kinematic viscosity of the base oil is preferably in the range of from 1 to 1,000 $mm^2/s$, more preferably from 2 to 320 $mm^2/s$ and still more preferably from 5 to 220 $mm^2/s$ as measured at 40° C., and further the kinematic viscosity of the base oil is preferably in the range of from 2 to 30 $mm^2/s$, more preferably from 3 to 15 $mm^2/s$ and still more preferably from 4 to 10 $mm^2/s$ as measured at 100° C.

When the kinematic viscosity of the base oil as measured at 40° C. lies within the range of from 1 to 1000 $mm^2/s$, the resulting lubricating oil composition is capable of not only sufficiently reducing friction at sliding portions such as gear bearings and clutches in an automatic transmission of a compressor, but also exhibiting good low-temperature properties. Also, when the kinematic viscosity of the base oil as measured at 100° C. lies within the range of from 2 to 30 $mm^2/s$, the resulting lubricating oil composition hardly suffers from evaporation loss, and power loss of the compressor owing to a viscosity resistance of the lubricating oil composition can be well suppressed, which results in the effect of improving a fuel consumption.

Also, the base oil preferably has a % $C_A$ value of 10 or less as measured by ring analysis, and a sulfur content of 300 ppm by mass or less.

The % $C_A$ value as measured by ring analysis as used herein means a proportion (percentage) of an aromatic component in the base oil which is calculated by a ring analysis n-d-M method. The sulfur content as used herein means the value as measured according to JIS K 2541.

When using the base oil having a % $C_A$ value of 10 or less and a sulfur content of 300 ppm by mass or less, the base oil exhibits a good oxidation stability, and the resulting lubricating oil composition is prevented from suffering of increase in acid value and formation of sludge. The % $C_A$ value of the base oil is more preferably 3.0 or less, still more preferably 1.0 or less and especially preferably 0.5 or less. The sulfur content of the base oil is more preferably 200 ppm by mass or less, still more preferably 100 ppm by mass or less and especially preferably 30 ppm by mass or less.

In addition, the viscosity index of the base oil is preferably 70 or more, more preferably 100 or more, and still more preferably 120 or more. The base oil having a viscosity index of 70 or more exhibits a less change in viscosity depending on the change in temperature.

The lubricating oil composition according to the present invention is compounded with the phosphorus compound represented by the above general formula (I). The phosphorus compound has a phosphorous acid ester (phosphite) structure and a hindered phenol structure in the same molecule thereof. By using such a phosphorus compound, the resulting lubricating oil composition can be enhanced in wear resistance, high-temperature detergency and base number retention property, in particular, even though the phosphorus content, sulfur content and metal content therein are reduced.

In the following, the phosphorus compound represented by the above general formula (I) is explained.

In the above general formula (I), $R^1$, $R^2$, $R^4$ and $R^5$ are each independently one group selected from the group consisting of a hydrogen atom, an alkyl group having 1 to 8 carbon atoms, a cycloalkyl group having 5 to 8 carbon atoms, an alkylcycloalkyl group having 6 to 12 carbon atoms, an aralkyl group having 7 to 12 carbon atoms and a phenyl group; $R^3$ is a hydrogen atom or an alkyl group having 1 to 8 carbon atoms; X is one group selected from the group consisting of a simple bond, a sulfur atom and a —$CHR^6$— group (wherein $R^6$ is one group selected from the group consisting of a hydrogen atom, an alkyl group having 1 to 8 carbon atoms and a cycloalkyl group having 5 to 8 carbon atoms); A is an alkylene group having 2 to 8 carbon atoms or a *—$COR^7$— group (wherein $R^7$ is a simple bond or an alkylene group having 1 to 8 carbon atoms, and the symbol (*) indicates a side on which the group is bonded to oxygen); and either one of Y and Z is one group selected from the group consisting of a hydroxyl group, an alkoxy group having 1 to 8 carbon atoms and an aralkyloxy group having 7 to 12 carbon atoms, and the other of Y and Z is a hydrogen atom or an alkyl group having 1 to 8 carbon atoms.

In the phosphorus compound represented by the above general formula (I), typical examples of the alkyl group having 1 to 8 carbon atoms include a methyl group, an ethyl group, an n-propyl group, an i-propyl group, an n-butyl group, an i-butyl group, a sec-butyl group, a t-butyl group, a t-pentyl group, an i-octyl group, a t-octyl group and a 2-ethylhexyl group. Typical examples of the cycloalkyl group having 5 to 8 carbon atoms include a cyclopentyl group, a cyclohexyl group, a cycloheptyl group and a cyclooctyl group. Typical examples of the alkylcycloalkyl group having 6 to 12 carbon atoms include a 1-methylcyclopentyl group, a 1-methylcyclohexyl group and a 1-methyl-4-i-propylcyclohexyl group. Typical examples of the aralkyl group having 7 to 12 carbon atoms include a benzyl group, an α-methylbenzyl group and an α,α-dimethylbenzyl group.

The preferred groups as $R^1$, $R^2$ and $R^4$ are respectively an alkyl group having 1 to 8 carbon atoms, a cycloalkyl group having 5 to 8 carbon atoms and an alkylcycloalkyl group having 6 to 12 carbon atoms. Among these groups, from the viewpoint of enhancing a dissolvability in the base oil, the more preferred groups as $R^1$ and $R^4$ are t-alkyl groups such as a t-butyl group, a t-pentyl group and a t-octyl group, as well as a cyclohexyl group and a 1-methylcyclohexyl group, and especially preferred groups as $R^1$ and $R^4$ are a t-butyl group and a t-pentyl group.

The more preferred groups as $R^2$ are an alkyl group having 1 to 8 carbon atoms and a cycloalkyl group having 5 to 8 carbon atoms. Among these groups, from the viewpoints of a good availability of raw materials, etc., the still more preferred groups as $R^2$ are alkyl groups having 1 to 5 carbon atoms such as a methyl group, an ethyl group, an n-propyl group, an i-propyl group, an n-butyl group, an i-butyl group, a sec-butyl group, a t-butyl group and a t-pentyl group, and especially preferred groups as $R^2$ are a methyl group , a t-butyl group and a t-pentyl group.

The more preferred groups as $R^5$ are an alkyl group having 1 to 8 carbon atoms and a cycloalkyl group having 5 to 8 carbon atoms. Among these groups, the still more preferred groups as $R^5$ include a hydrogen atom, and alkyl groups having 1 to 5 carbon atoms such as a methyl group, an ethyl group, an n-propyl group, an i-propyl group, an n-butyl group, an i-butyl group, a sec-butyl group, a t-butyl group and a t-pentyl group.

$R^3$ represents a hydrogen atom or an alkyl group having 1 to 8 carbon atoms. As the alkyl group having 1 to 8 carbon atoms, there may be mentioned, for example, the same alkyl groups as described above. Among these groups, preferred are a hydrogen atom and an alkyl group having 1 to 5 carbon atoms, and especially preferred are a hydrogen atom and a methyl group.

X represents a simple bond (this means that two phenoxy group skeleton-containing groups are directly bonded to each other), a sulfur atom or a methylene group which may be substituted with an alkyl group having 1 to 8 carbon atoms or a cycloalkyl group having 5 to 8 carbon atoms, i.e., such a group as represented by a —$CHR^6$— group.

As the alkyl group having 1 to 8 carbon atoms and the cycloalkyl group having 5 to 8 carbon atoms as a substituent group which may be bonded to the methylene group, there may be mentioned the same alkyl groups and cycloalkyl groups as described above, respectively. Among them, from the viewpoint of a good heat resistance of the resulting lubricating oil composition, X is preferably any one of a simple bond, a methylene group and a substituted methylene group having a substituent group such as a methyl group, an ethyl group, an n-propyl group, an i-propyl group, an n-butyl group, an i-butyl group and a t-butyl group.

A is an alkylene group having 2 to 8 carbon atoms or a *—$COR^7$— group (wherein $R^7$ is a simple bond or an alkylene group having 1 to 8 carbon atoms).

Typical examples of the alkylene group having 2 to 8 carbon atoms include an ethylene group, a propylene group, a butylene group, a pentamethylene group, a hexamethylene group, an octamethylene group and a 2,2-dimethyl-1,3-propylene group. Among these alkylene groups, a propylene group is preferably used.

The symbol (*) in the *—$COR^7$— group indicates that the carbonyl group is bonded to oxygen of the phosphite. Typical examples of the alkylene group having 1 to 8 carbon atoms as $R^7$ include a methylene group, an ethylene group, a propylene group, a butylene group, a pentamethylene group, a hexamethylene group, an octamethylene group and a 2,2-dimethyl-1,3-propylene group. Among them, a simple bond, an ethylene group or the like is preferred as $R^7$.

Either one of Y and Z is one group selected from the group consisting of a hydroxyl group, an alkoxy group having 1 to 8 carbon atoms and an aralkyloxy group having 7 to 12 carbon atoms, and the other of Y and Z is a hydrogen atom or an alkyl group having 1 to 8 carbon atoms.

Examples of the alkyl group having 1 to 8 carbon atoms as Y or Z include the same alkyl groups as described above. Examples of the alkoxy group having 1 to 8 carbon atoms as Y or Z include those alkoxy groups whose alkyl moiety is the same as the above alky group having 1 to 8 carbon atoms. Examples of the aralkyloxy group having 7 to 12 carbon atoms as Y or Z include those aralkyloxy groups whose aralkyl moiety is the same as the above aralkyl group having 7 to 12 carbon atoms.

The phosphorus compound represented by the above general formula (I) may be produced, for example, by reacting a bisphenol compound represented by the following general formula (II), a phosphorus trihalide and a hydroxy compound represented by the following general formula (III).

(II)

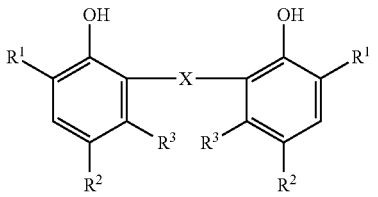

-continued (III)

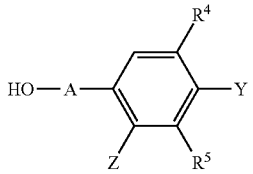

In the above general formulae (II) and (III), $R^1$, $R^2$, $R^3$ and X are the same as those described above, and $R^4$, $R^5$, A and Y are also the same as those described above.

Examples of the phosphorus trihalide include phosphorus trichloride and phosphorus tribromide. Among these phosphorus trihalides, phosphorus trichloride is especially preferably used.

The above reaction may be usually carried out by a two stage reaction method in which the bisphenol compound (II) is first reacted with the phosphorus trichloride to produce an intermediate product, and the thus obtained intermediate product is then reacted with the hydroxy compound (III).

Typical examples of the phosphorus compound represented by the general formula (I) include 6-[3-(3-t-butyl-4-hydroxy-5-methylphenyl)propoxy]-2,4,8,10-tetra-t-butyl dibenzo[d,f][1,3,2]-dioxaphosphepine, 2,10-dimethyl-4,8-di-t-butyl-6-[3-(3,5-di-t-butyl-4-hydroxyphenyl)propoxy]-12H-dibenzo[d,g][1,3,2]dioxaphosphocine, 2,4,8,10-tetra-t-butyl-6-[3-(3,5-di-t-butyl-4-hydroxyphenyl)propoxy] dibenzo[d,f][1,3,2]dioxaphosphepine, 2,4,8,10-tetra-t-pentyl-6-[3-(3,5-di-t-butyl-4-hydroxyphenyl)propoxy]-12-methyl-12H-dibenzo[d,g][1,3,2]dioxaphosphocine, 2,10-dimethyl-4,8-di-t-butyl-6-[3-(3,5-di-t-butyl-4-hydroxyphenyl)propionyloxy]-12H-dibenzo[d,g][1,3,2] dioxaphosphocine, 2,4,8,10-tetra-t-pentyl-6-[3-(3,5-di-t-butyl-4-hydroxyphenyl)propionyloxy]-12-methyl-12H-dibenzo[d,g][1,3,2]dioxaphosphocine, 2,4,8,10-tetra-t-butyl-6-[3-(3,5-di-t-butyl-4-hydroxyphenyl)propionyloxy]-dibenzo[d,f][1,3,2]dioxaphosphepine, 2,10-dimethyl-4,8-di-t-butyl-6-(3,5-di-t-butyl-4-hydroxybenzoyloxy)-12H-dibenzo[d,g][1,3,2]dioxaphosphocine, 2,4,8,10-tetra-t-butyl-6-(3,5-di-t-butyl-4-hydroxybenzoyloxy)-12-methyl-12H-dibenzo[d,g][1,3,2]dioxaphosphocine, 2,4,8,10-tetra-t-butyl-6-[3-(3-methyl-4-hydroxy-5-t-butylphenyl)propoxy] dibenzo[d,f][1,3,2]dioxaphosphepine, 2,10-dimethyl-4,8-di-t-butyl-6-[3-(3-methyl-4-hydroxy-5-t-butylphenyl) propoxy]-12H-dibenzo[d,g][1,3,2]dioxaphosphocine, 2,4,8,10-tetra-t-butyl-6-[3-(3,5-di-t-butyl-4-hydroxyphenyl) propoxy]-12H-dibenzo[d,g][1,3,2]dioxaphosphocine, 2,10-diethyl-4,8-di-t-butyl-6-[3-(3,5-di-t-butyl-4-hydroxyphenyl) propoxy]-12H-dibenzo[d,g][1,3,2]dioxaphosphocine, and 2,4,8,10-tetra-t-butyl-6-[2,2-dimethyl-3-(3-t-butyl-4-hydroxy-5-methylphenyl)propoxy]-dibenzo[d,f][1,3,2]dioxaphosphepine.

In the present invention, these phosphorus compounds represented by the general formula (I) may be used alone or in the form of a mixture of any two or more thereof. The phosphorus compound represented by the general formula (I) is preferably compounded in the lubricating oil composition in an amount of from 0.01 to 10% by mass, more preferably from 0.05 to 5% by mass, still more preferably from 0.1 to 3% by mass and especially preferably from 0.5 to 2% by mass on the basis of a total amount of the composition.

When the amount of the phosphorus compound of the general formula (I) to be compounded is 0.01% by mass or larger, the resulting lubricating oil composition has a good thermal stability and a good oxidation stability, and is free from formation of varnishing, as well as can exhibit good properties such as wear resistance, high-temperature detergency and base number retention property. On the other hand, when the amount of the phosphorus compound of the general formula (I) to be compounded is 10% by mass or smaller, deterioration of an exhaust gas purification catalyst for automobiles owing to increase in phosphorus content in the lubricating oil composition can be suppressed to a sufficient extent, and further it is economically advantageous.

In the lubricating oil composition of the present invention, at least one additive selected from the group consisting of an antioxidant, an ashless dispersant, a metallic detergent, a friction modifier, an extreme-pressure agent, a rust inhibitor, a viscosity index improver, a pour point depressant, a metal deactivator, a defoaming agent, a demulsifier and a colorant is preferably further compound therein.

The antioxidant used in the present invention is preferably in the form of a phosphorus-free antioxidant. Examples of the phosphorus-free antioxidant include phenol-based antioxidants, amine-based antioxidants, molybdenum/amine complex-based antioxidants and sulfur-based antioxidants.

Specific examples of the phenol-based antioxidants include 4,4'-methylenebis(2,6-di-t-butyl phenol), 4,4'-bis(2,6-di-t-butyl phenol), 4,4'-bis(2-methyl-6-t-butyl phenol), 2,2'-methylenebis(4 ethyl-6-t-butyl phenol), 2,2'-methylenebis(4-methyl-6-t-butyl phenol), 4,4'-butylenebis(3-methyl-6-t-butyl phenol), 4,4'-isopropylidenebis(2,6-di-t-butyl phenol), 2,2'-methylenebis(4-methyl-6-nonyl phenol), 2,2'-isobutylidenebis(4,6-dimethyl phenol), 2,2'-methylenebis(4-methyl-6-cyclohexyl phenol), 2,6-di-t-butyl-4-methyl phenol, 2,6-di-t-butyl-4-ethyl phenol, 2,4-dimethyl-6-t-butyl phenol, 2,6-di-t-amyl-p-cresol, 2,6-di-t-butyl-4-(N,N'-dimethylaminomethyl phenol), 4,4'-thiobis(2-methyl-6-t-butyl phenol), 4,4'-thiobis(3-methyl-6-t-butyl phenol), 2,2'-thiobis(4-methyl-6-t-butyl phenol), bis(3-methyl-4-hydroxy-5-t-butyl benzyl)sulfide, bis(3,5-di-t-butyl-4-hydroxybenzyl)sulfide, n-octyl-3-(4-hydroxy-3,5-di-t-butyl phenyl)propionate, n-octadecyl-3-(4-hydroxy-3,5-di-t-butyl phenyl)propionate, and 2,2'-thio[diethyl-bis-3-(3,5-di-t-butyl-4-hydroxyphenyl)propionate].

Among these phenol-based antioxidants, especially preferred are bisphenol-based antioxidants and ester group-containing phenol-based antioxidants. Further, from the viewpoint of a high instantaneous effect on high-temperature heat history under a high-pressure condition, preferred are phenols having a molecular weight of 340 or more.

Specific examples of the amine-based antioxidants include monoalkyldiphenylamines such as p,p'-dioctyl-diphenylamine, p,p'-di-α-methylbenzyl-diphenylamine, N-p-butylphenyl-N-p'-octylphenylamine, mono-t-butyldiphenylamine, monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine,; polyalkyldiphenylamines such as tetrabutyldiphenylamine, tetrahexyldiphenylamine, tetraoctyldiphenylamine and tetranonyldiphenylamine; styrenated diphenylamines, 4,4'-bis-(α,α-dimethylbenzyl)diphenylamine, and phenyl-α-naphthyl amines such as methylphenyl-1-naphthylamine, ethylphenyl-1-naphthylamine, butylphenyl-1-naphthylamine, hexylphenyl-1-naphthylamine, octylphenyl-1-naphthylamine and N-t-dodecylphenyl-1-naphthylamine; bis(dialkylphenyl)amines such as di(2,4-diethylphenyl)amine and di(2-ethyl-4-nonylphenyl)amine; 1-naphthylamine, and arylnaphthylamines such as phenyl-1-naphthylamine, phenyl-2-naphthylamine, N-hexylphenyl-2-naphthylamine, N-octylphenyl-2-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine; phenylenediamines such as N,N'-diisopropyl-p-phenylenediamine and N,N'-diphenyl-p-phenylenediamine; and phenothiazines such as phenothiazine and 3,7-dioctyl phenothiazine.

Among these amine-based antioxidants, the phenyl-α-naphthylamines, aikyldiphenylamines and dialkyldiphenylamines are preferably used alone or in combination of any two or more thereof. In particular, from the viewpoints of a good oxidation stability (anti-oxidation perfomance) and a good anti-varnishing performance, dioctyldiphenylamine and N-(p-octylphenyl)-1-naphthylamine are more preferably used in combination with each other.

As the molybdenum/amine complex-based antioxidants, there may be used compounds obtained by reacting a hexavalent molybdenum compound, more specifically, molybdenum trioxide and/or molybdic acid with an amine compound, for example, those compounds obtained according to the production method described in JP-A 2003-252887.

The amine compound to be reacted with the hexavalent molybdenum compound is not particularly limited. Concretely, examples of the amine compound include monoamines, diamines, polyamines and alkanol amines. Specific examples of the amine compound include alkyl amines containing an alkyl group having 1 to 30 carbon atoms (in which the alkyl group may be either a linear alkyl group or a branched alkyl group) such as methylamine, ethylamine, dimethylamine, diethylamine, methylethylamine and methylpropylamine; alkenyl amines containing an alkenyl group having 2 to 30 carbon atoms (in which the alkenyl group may be either a linear alkenyl group or a branched alkenyl group) such as ethenyl amine, propenyl amine, butenyl amine, octenyl amine and oleyl amine; alkanol amines containing an alkanol group having 1 to 30 carbon atoms (in which the alkanol group may be either a linear alkanol group or a branched alkanol group) such as methanol amine, ethanol amine, methanol ethanol amine and methanol propanol amine; alkylene diamines containing an alkylene group having 1 to 30 carbon atoms such as methylenediamine, ethylenediamine, propylenediamine and butylenediamine; polyamines such as diethylenetriamine, triethylenetetramine, tetraethylenepentamine and pentaethylenehexamine; compounds obtained by further substituting the above monoamines, diamines or polyamines with an alkyl or alkenyl group having 8 to 20 carbon atoms, such as undecyldiethylamine, undecyldiethanol amine, dodecyldipropanol amine, oleyldiethanol amine, oleylpropylenediamine and stearyltertraethylenepentamine; heterocyclic compounds such as imidazoline; alkyleneoxide adducts of these compounds; and mixtures of these compounds.

In addition, as the molybdenum/amine complex-based antioxidants, there may be used, for example, sulfur-containing molybdenum complexes of succinic imide as described in JP-B 3-22438 and JP-A 2004-2866.

Examples of the sulfur-based antioxidants include phenothiazine, pentaerythritol-tetrakis-(3-lauryl thiopropionate), didodecyl sulfide, dioctadecyl sulfide, didodecyl thiodipropionate, dioctadecyl thiodipropionate, dimyristyl thiodipropionate, dodecyloctadecyl thiodipropionate and 2-mercaptobenzimidazole.

Among these antioxidants, in view of reducing a metal content and a sulfur content in the resulting composition, preferred are phenol-based antioxidants and amine-based antioxidants. Form the viewpoint of a good oxidation stability (anti-oxidation performance) and a good anti-varnishing performance, more preferred are amine-based antioxidants.

These antioxidants may be used alone or in the form of a mixture of any two or more thereof. Among them, from the viewpoint of attaining a good oxidation stability effect, a mixture of one or more kinds of phenol-based antioxidants and one or more kinds of amine-based oxidants is preferably used.

The amount of the antioxidant compounded in the lubricating oil composition is usually in the range of preferably from 0.01 to 5% by mass and more preferably from 0.1 to 3% by mass on the basis of a total amount of the composition.

The ashless dispersant used in the present invention may be an optional ashless dispersant which is generally used for lubricating oils. Examples of the ashless dispersant include polybutenyl succinic imides, polybutenyl benzylamines and polybutenyl amines which contain a polybutenyl group having a number-average molecular weight of 900 to 3,500, as well as derivatives of these compounds such as boric acid-modified products thereof. These ashless dispersants may be used alone or in combination of any optional two or more thereof. The amount of the ashless dispersant compounded in the lubricating oil composition is usually in the range of from 0.01 to 10% by mass on the basis of a total amount of the composition.

Suitable examples of the ashless dispersant include a mono-type succinic imide compound represented by the following general formula (IV) or a bis-type succinic imide compound represented by the following general formula (V).

(IV)

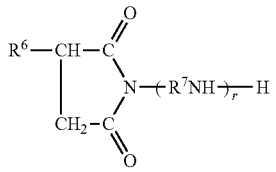

(V)

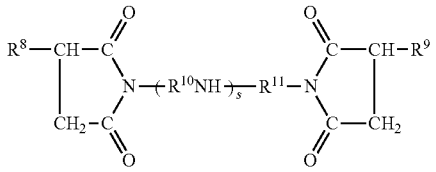

In the above general formulae (IV) and (V), $R^6$, $R^8$ and $R^9$ are respectively an alkenyl group or an alkyl group having a number-average molecular weight of from 500 to 4,000, and $R^8$ and $R^9$ may be the same or different from each other. The number-average molecular weight of each of $R^6$, $R^8$ and $R^9$ is preferably from 1,000 to 4,000.

Also, $R^7$, $R^{10}$ and $R^{11}$ are respectively an alkylene group having 2 to 5 carbon atoms, and $R^{10}$ and $R^{11}$ may be the same or different from each other. The suffix r is an integer of 1 to 10, and the suffix s is 0 or an integer of 1 to 10.

When the number-average molecular weight of each of $R^6$, $R^8$ and $R^9$ is 500 or more, the ash-free dispersant exhibits a good dissolvability in the base oil. When the number-average molecular weight of each of $R^6$, $R^8$ and $R^9$ is 4,000 or less, the resulting composition is free from deterioration in detergency thereof.

The suffix r is preferably an integer of 2 to 5 and more preferably 3 or 4. When the suffix r is 1 or more, the resulting composition exhibits a good detergency. When the suffix r is 10 or less, the ashless dispersant exhibits a good dissolvability in the base oil.

Further, in the general formula (V), the suffix s is preferably an integer of 1 to 4 and more preferably 2 or 3. When the suffix s lies within the above-specified range, the detergency of the resulting composition and the dissolvability of the ashless dispersant in the base oil can be suitably improved.

Examples of the alkenyl group as $R^6$, $R^8$ and $R^9$ include a polybutenyl group, a polyisobutenyl group and an ethylene-propylene copolymer group. Examples of the alkyl group include those groups obtained by hydrogenating these alkenyl groups.

Typical examples of the suitable alkenyl group include a polybutenyl group and a polyisobutenyl group.

The polybutenyl group may be obtained by polymerizing a mixture of 1-butene and isobutene, or high-purity isobutene.

Typical examples of the suitable alkyl group include those groups obtained by hydrogenating a polybutenyl group and a polyisobutenyl group.

The above alkenyl succinic imide compound or alkyl succinic imide compound may be usually produced by reacting an alkenyl succinic anhydride obtained by reacting a polyolefin with maleic anhydride or an alkyl succinic anhydride obtained by hydrogenating the alkenyl succinic anhydride, with a polyamine.

Also, the above mono-type succinic imide compound or bis-type succinic imide compound may be produced by varying a proportion between the alkenyl succinic anhydride or alkyl succinic anhydride and the polyamide to be reacted.

As an olefin monomer constituting the above polyolefin, there may be used an α-olefin having 2 to 8 carbon atoms or a mixture of the two or more α-olefins. Among them, a mixture of isobutene and butene-1 is more suitably used.

Examples of the polyamine include single diamines such as ethylenediamine, propylenediamine, butylenediamine and pentylenediamine; polyalkylene polyamines such as diethylenetriamine, triethylenetetramine, tetraethylenepentamine, pentaethylenehexamine, di(methylethylene)triamine, dibutylenetriamine, tributylenetetramine and pentapentylenehexamine; and piperazine derivatives such as aminoethyl piperazine.

In addition to the above alkenyl succinic imide compound or alkyl succinic imide compound, there may also be used boron derivatives of these compounds and/or organic acid-modified products of these compounds.

The boron derivatives of the alkenyl succinic imide compound or alkyl succinic imide compound which are used in the present invention may be produced by an ordinary method. For example, the boron derivatives may be produced by reacting the above polyolefin with maleic anhydride to obtain an alkenyl succinic anhydride, and then reacting the resulting alkenyl succinic anhydride with an intermediate product obtained by reacting the above polyamine with a boron compound such as boron oxide, a boron halide, a boric acid anhydride, a boric acid ester and an ammonium salt of orthoboric acid to subject the alkenyl succinic anhydride to imidization.

The content of boron in the boron derivatives is not particularly limited, and is preferably in the range of from 0.05 to 5% by mass and more preferably from 0.1 to 3% by mass in terms of a boron element.

The mono-type succinic imide compound represented by the general formula (IV) or the bis-type succinic imide compound represented by the general formula (V) is preferably compounded in the lubricating oil composition in an amount of from 0.5 to 15% by mass and more preferably from 1 to 10% by mass on the basis of a total amount of the lubricating oil composition.

When the amount of the succinic imide compound to be compounded is 0.5% by mass or more, effects by addition of the succinic imide compound can be exhibited to a sufficient extent. When the amount of the succinic imide compound compounded is 15% by mass or less, the effects corresponding to the amount of the succinic imide compound compounded can be suitably attained.

These succinic imide compounds may be used alone or in combination of any two or more thereof as long as they are compounded in the above-specified range.

As the above metallic detergent, there may be used optional alkaline earth metal-based detergents which are employed for ordinary lubricating oils. Examples of the alkaline earth metal-based detergents include alkaline earth metal sulfonates, alkaline earth metal phenates, alkaline earth metal salicylates, and mixtures of two or more compounds selected from the group consisting of these alkaline earth metal salts.

Examples of the alkaline earth metal sulfonates include alkaline earth metal salts of an alkyl aromatic sulfonic acid obtained by sulfonating an alkyl aromatic compound having a molecular weight of from 300 to 1,500 and preferably from 400 to 700. Among these alkaline earth metal salts, preferred are magnesium salts and/or calcium salts, and more preferred are calcium salts.

Examples of the alkaline earth metal phenates include alkaline earth metal salts of alkyl phenols, alkyl phenol sulfides and Mannich reaction products of alkyl phenols. Among these alkaline earth metal salts, preferred are magnesium salts and/or calcium salts, and more preferred are calcium salts.

Examples of the alkaline earth metal salicylates include alkaline earth metal salts of alkyl salicylic acids. Among these alkaline earth metal salts, preferred are magnesium salts and/or calcium salts, and more preferred are calcium salts.

The alkyl group contained in the compounds constituting the above alkaline earth metal-based detergents preferably includes alkyl groups having 4 to 30 carbon atoms and more preferably alkyl groups having 6 to 18 carbon atoms. These alkyl groups may be either linear or branched, and may also be in the form of either a primary alkyl group, a secondary alkyl group or a tertiary alkyl group.

Examples of the alkaline earth metal sulfonates, alkaline earth metal phenates and alkaline earth metal salicylates include neutral alkaline earth metal sulfonates, neutral alkaline earth metal phenates and neutral alkaline earth metal salicylates which may be produced by directly reacting the above alkyl aromatic sulfonic acids, alkyl phenols, alkyl phenol sulfides, Mannich reaction products of alkyl phenols, alkyl salicylic acids or the like with an alkaline earth metal base such as oxides or hydroxides of alkaline earth metals such as magnesium and/or calcium, or which may be produced by once forming an alkali metal salt of the alkyl aromatic sulfonic acids, alkyl phenols, alkyl phenol sulfides, Mannich reaction products of alkyl phenols, alkyl salicylic acids or the like and then substituting the resulting alkali metal salt with an alkaline earth metal salt. Further, as the alkaline earth metal sulfonates, alkaline earth metal phenates and alkaline earth metal salicylates, there may also be used basic alkaline earth metal sulfonates, basic alkaline earth metal phenates and basic alkaline earth metal salicylates which may be produced by heating the neutral alkaline earth metal sulfonates, neutral alkaline earth metal phenates and neutral alkaline earth metal salicylates together with an excess amount of an alkaline earth metal salt or an alkaline earth metal base in the presence of water, as well as perbasic alkaline earth metal sulfonates, perbasic alkaline earth metal phenates and perbasic alkaline earth metal salicylates which may be produced by reacting the neutral alkaline earth metal sulfonates, neutral alkaline earth metal phenates and neutral alkaline earth metal salicylates with an alkaline earth metal carbonate or an alkaline earth metal borate in the presence of carbon dioxide.

The total base number of the metallic detergent used in the present invention is preferably in the range of from 10 to 500 mg KOH/g and more preferably from 15 to 450 mg KOH/g. These metallic detergents may be used alone or in combination of any two or more selected therefrom.

The "total base number" as used herein means the value measured by potentiometric titration method (base number/perchlorate method) according to the Item 7 of JIS K 2501 "Petroleum Products and Lubricants-Neutralization Number Testing Method".

The metal ratio of the metallic detergent used in the present invention is not particularly limited. The metallic detergents usually having a metal ratio of 20 or more may be used alone or in the form of a mixture of any two or more thereof. More suitably, the metallic detergent preferably having a metal ratio of 3 or less, more preferably 1.5 or less and still more preferably 1.2 or less is used as an essential component because the lubricating oil composition containing such a metallic detergent is more excellent in oxidation stability or base number retention property, as well as high-temperature detergency, etc.

Meanwhile, the term "metal ratio" as used herein means the ratio represented by the formula: (valence of a metal element in the metallic detergent)×(content (mol %) of the metal element)/(content (mol %) of a soap group in the metallic detergent) wherein the metal element is calcium, magnesium, etc., and the soap group is a sulfonic group, a phenol group, a salicylic group, etc.

As the metallic detergent used in the present invention, for the purpose of reducing a sulfur content of the resulting composition, preferred are alkaline earth metal salicylates and alkaline earth metal phenates. Among them, more preferred are perbasic alkaline earth metal salicylates and perbasic alkaline earth metal phenates, and especially preferred is perbasic calcium salicylate.

The amount of the metallic detergent to be compound in the lubricating oil composition according to the present invention is preferably in the range of from 0.01 to 20% by mass, more preferably from 0.1 to 10% by mass and still more preferably from 0.5 to 5% by mass on the basis of a total amount of the lubricating oil composition. When the amount of the metallic detergent compounded is 0.01% b y mass or more, the effect by addition of the metallic detergent can be exhibited to a sufficient extent. On the other hand, when the amount of the metallic detergent compounded is 20% by mass or less, the effect corresponding to the amount of the metallic detergent compounded can be usually attained.

However, in the present invention, it is important that the upper limit of the amount of the metallic detergent compounded is reduced to as low a level as possible even though it lies within the above-specified range. When compounding the metallic detergent in such a reduced amount, the metal content, i.e., sulfated ash content of the lubricating oil composition can be lessened, whereby it is possible to prevent exhaust gas purification catalysts for automobiles from suffering from deterioration in their catalyst performance.

The metallic detergents may be used alone or in combination of any two or more thereof as long as the content thereof lies within the above-specified range.

Examples of the viscosity index improvers include polymethacrylates, dispersed-type polymethacrylates, olefin-based copolymers (such as, for example, ethylene-propylene copolymers), dispersed-type olefin-based copolymers and styrene-based copolymers (such as, for example, styrene-diene copolymers and styrene-isoprene copolymers).

The amount of the viscosity index improver to be compounded in the lubricating oil composition is preferably in the range of from 0.5 to 15% by mass and more preferably from 1 to 10% by mass on the basis of a total amount of the lubricating oil composition from the viewpoint of good effects by addition thereof.

Examples of the pour point depressants include polymethacrylates having a weight-average molecular weight of from about 5,000 to about 50,000.

The amount of the pour point depressant to be compounded in the lubricating oil composition is usually from about 0.1 to about 2% by mass and preferably from 0.1 to 1% by mass on the basis of a total amount of the lubricating oil composition from the viewpoint of good effects by addition thereof.

Examples of the metal deactivator include benzotriazole-based compounds, tolyl triazole-based compounds, thiadiazole-based compounds and imidazole-based compounds.

The amount of the metal deactivator to be compounded in the lubricating oil composition is preferably in the range of from 0.01 to 3% by mass and more preferably from 0.01 to 1% by mass on the basis of a total amount of the lubricating oil composition.

Examples of the rust inhibitor include fatty acids, alkenyl succinic acid half esters, fatty acid soaps, alkyl sulfinic acid salts, sulfonates of alkali earth metals (such as calcium (Ca), magnesium (Mg) and barium (Ba)), petroleum sulfonates, alkyl benzene sulfonates, dinonyl naphthalene sulfonates, phenates, salicylates and naphthenates, alkenyl succinic acid esters, polyhydric alcohol esters, polyhydric alcohol fatty acid esters, fatty acid amines, paraffin oxides and alkyl polyoxyethylene ethers.

The amount of the rust inhibitor to be compounded in the lubricating oil composition is preferably in the range of from 0.01 to 5% by mass, more preferably from 0.01 to 1% by mass and still more preferably from 0.05 to 0.5% by mass on the basis of a total amount of the lubricating oil composition from the viewpoint of good effects by addition thereof.

Examples of the defoaming agent include silicone oils, fluoro-silicone oils, polyacrylates and fluoroalkyl ethers. The amount of the defoaming agent to be compounded in the lubricating oil composition is preferably in the range of from 0.0005 to 0.5% by mass, more preferably from 0.005 to 0.5% by mass and still more preferably from 0.01 to 0.2% by mass on the basis of a total amount of the lubricating oil composition from the viewpoint of a good balance between defoaming effect and economy.

Examples of the demulsifier include ethylene-propylene block copolymers, and sulfonates, phenates, salicylates and naphthenates of alkali earth metals (such as calcium (Ca) and magnesium (Mg)). The amount of the demulsifier to be compounded in the lubricating oil composition is usually from 0.0005 to 1% by mass.

As the colorant, there may be used dyes or pigments. The amount of the colorant to be compounded in the lubricating oil composition is usually from 0.001 to 1% by mass on the basis of a total amount of the lubricating oil composition.

The lubricating oil composition of the present invention may also contain a friction modifier, an anti-wear agent and an extreme pressure agent, if required.

As the friction modifier, there may be used optional compounds ordinarily used as friction modifiers for lubricating oils. Examples of the friction modifier include organic molybdenum-based compounds, and compounds containing at least one alkyl or alkenyl group having 6 to 30 carbon atoms in a molecule thereof, such as fatty acid esters, fatty acid amides, fatty acids, aliphatic alcohols, aliphatic amines, aliphatic ethers, sulfurized esters, phosphoric acid esters, phosphorous acid esters and phosphoric acid ester amine salts.

The amount of the friction modifier or friction reducing agent to be compounded in the lubricating oil composition is preferably in the range of from 0.01 to 10% by mass, more preferably from 0.01 to 2% by mass and still more preferably from 0.01 to 1% by mass on the basis of a total amount of the lubricating oil composition.

Examples of the anti-wear agent or the extreme-pressure additive include sulfur-containing compounds such as zinc dithiophosphate, zinc phosphate, zinc dithiocarbamate, molybdenum dithiocarbamate, molybdenum dithiophosphate, disulfides, sulfurized olefins, sulfurized oils and fats, sulfurized esters, thiocarbonates, thiocarbamates and polysulfides; phosphorus-containing compounds such as phosphorous acid esters, phosphoric acid esters, phosphonic acid esters and amine salts or metal salts of these esters; and sulfur- and phosphorus-containing anti-wear agents such as thiophosphorous acid esters, thiophosphonic acid esters, thiophosphonic acid esters, and amine salts or metal salts of these esters.

The amount of the anti-wear agent or the extreme-pressure agent to be compounded in the lubricating oil composition is usually in the range of from 0.01 to 10% by mass on the basis of a total amount of the lubricating oil composition. However, if the anti-wear agent or the extreme-pressure agent is compounded in the lubricating oil composition, care should be taken such that the phosphorus content, sulfur content and metal content of the lubricating oil do not become excessive by addition of the anti-wear agent or the extreme pressure agent thereto.

The above-mentioned lubricating oil composition of the present invention preferably has the following properties.

(1) The sulfated ash content (as measured according to JIS K 2272) is 1.2% by mass or less, preferably 1.0% by mass or less and especially preferably 0.8% by mass or less.

(2) The phosphorus content (as measured according to JPI-5S-38-92) is 0.12% by mass or less, preferably 0.10% by mass or less and especially preferably 0.09% by mass or less.

(3) The sulfur content (as measured according to JIS K 2541) is 0.12% by mass or less, preferably 0.10% by mass or less and especially preferably 0.08% by mass or less.

The thus prepared lubricating oil composition of the present invention contains the base oil and the phosphorus compound having the structure represented by the above general formula (I). Therefore, the lubricating oil composition can exhibit all of the properties including not only a lubricating property but also a thermal stability, an oxidation stability and an anti-varnishing performance with a higher level, in particular, has such an effect of achieving a continuous long-term operation of a gas compressor. For this reason, the lubricating oil composition of the present invention can be suitably used as a so-called compressor oil.

In addition, the lubricating oil composition of the present invention capable of satisfying the above properties can also be suitably used as those for internal combustion engines to suppress deterioration or degradation of oxidation catalysts, three way catalysts, NOx occlusion type reducing catalysts, diesel particulate filters (DPF), etc., which are used in automobile engines. Further, in addition to the above-mentioned properties, the lubricating oil composition of the present invention can also exhibit enhanced basic properties required for lubricating oils for internal combustion engines such as wear resistance, high-temperature detergency and base number retention property.

Furthermore, the lubricating oil composition of the present invention can also be suitably used as lubricating oils not only in the above-mentioned applications but also in various other applications such as fluid coupling oils and torque transmitting oils, e.g., turbine oils, hydraulic pressure oils, gear oils, bearing oils, sliding surface oils and automatic transmission oils.

EXAMPLES

The present invention will be described in more detail by referring to the following Examples and Comparative Examples. However, it should be noted that these examples are only illustrative and not intended to limit the invention thereto.

Examples A1 to A6 and Comparative Examples A1 to A4

In the following respective Examples and Comparative Examples, the lubricating oil compositions shown in Table 1 (hereinafter occasionally referred to as "sample oils") were prepared from the base oils and the additives as described below.

(Base Oil)

(1) Mineral Oil: API classification GI; kinematic viscosity (40° C.): 29.28 $mm^2/s$ (2) Mineral Oil: API classification GII; kinematic viscosity (40° C.): 30.98 $mm^2/s$ (Additives)

(1) Antioxidant A: "Sumilizer GP" available from Sumitomo Chemical Co., Ltd. 6-[3-(3-t-butyl-4-hydroxy-5-methylphenyl)propoxy]-2,4,8,1.0-tetra-t-butyl dibenzo[d,f][1,3,2]-dioxaphosphepine (2) Antioxidant B: Dioctyl diphenyl amine (3) Antioxidant C: Octyl phenyl naphthyl amine (4) Antioxidant D: DBPC (4,4'-methylene-bis-2,6-di-t-butyl phenol)

(5) Others: Rust inhibitor (alkenyl succinic acid ester); metal deactivator (benzotriazole); defoaming agent (dimethyl silicone)

Next, the respective sample oils were subjected to lubricity test, thermal stability test and oxidation stability test (ISOT). The respective testing methods are described below. The evaluation results are shown in Table 1.

(Lubricity Test (Wear Resistance Test and Load Resistance Test))

Wear Resistance Test (Shell Wear Test):

The wear resistance test was carried out according to ASTM D 2783 under the conditions including a load of 192 N, a rotating speed of 1200 rpm, an oil temperature of 80° C. and a testing time of 60 min. An average wear track size was calculated from wear tracks on three ½ inch balls.

Load Resistance Test (Shell EP Test):

The load resistance test was carried out according to ASTM D 2783 at a rotating speed of 1800 rpm under a room temperature condition. A load wear index (LWI) was determined from a last non-scoring load (LNL) and a weld load (WL). The higher the LWI value, the more excellent the load resistance becomes.

(Thermal Stability Test)

The thermal stability test was carried out according to JIS K 2540. More specifically, the sample oil was held at 150° C. for 168 h, and then a kinematic viscosity, an acid value and a Millipore amount thereof were measured. The respective items were measured in the following manner.

Kinematic Viscosity:

Measured according to JIS K 2283. As the kinematic viscosity increases relative to that of a fresh oil, it is considered that a tendency of increase in viscosity of the sample oil becomes more remarkable.

Acid Value:

Measured according to JIS K 2501. As the acid value increases relative to that of a fresh oil, it is recognized that oxidative degradation of the sample oil proceeds more severely.

Millipore Amount:

Using a membrane filter having a pore size of 0.8 μm, 100 mL of the sample oil after subjected to the thermal stability test was filtered under reduced pressure. The masses of the sample oil before and after being filtered were measured to determine an insoluble content in the sample oil as a residue collected on the filter. As the Millipore amount increases, it is recognized that the insoluble content in the sample oil (varnishing) becomes larger.

(Oxidation Stability Test (Ism))

The oxidation stability test was carried out according to JIS K 2514. More specifically, the sample oil maintained at 165.5° C. was forcibly stirred at a rotating speed of 1300 rpm in the presence of a steel-copper catalyst and held under the stirring condition for 96 h while incorporating ambient air into the sample oil. Thereafter, the sample oil was tested in the same manner as in the above thermal stability test to measure a kinematic viscosity, an acid value and a Millipore amount thereof. Since ISOT is an accelerated test for oxidative degradation of the sample oil, the influence of air on oxidation of the sample oil is more remarkably observed as compared to that in the above thermal stability test.

TABLE 1

| | | | Examples | | | | | | Comparative Examples | | | |
|---|---|---|---|---|---|---|---|---|---|---|---|---|
| | | | A1 | A2 | A3 | A4 | A5 | A6 | A1 | A2 | A3 | A4 |
| Composition | | | | | | | | | | | | |
| Base oil (mass %) | API classification GI | | — | — | 99.0 | — | — | — | 99.0 | — | — | — |
| | API classification GII | | 99.5 | 99.0 | — | 97.5 | 97.0 | 96.9 | — | 99.0 | 99.0 | 97.5 |
| Additives (mass %) | Antioxidant A | | 0.5 | 1.0 | 1.0 | 0.5 | 0.5 | 0.5 | — | — | — | — |
| | Antioxidant B | | — | — | — | 2.0 | 2.0 | 2.0 | — | — | 1.0 | 2.0 |
| | Antioxidant C | | — | — | — | — | 0.5 | 0.5 | — | — | — | — |
| | Antioxidant D | | — | — | — | — | — | — | 1.0 | 1.0 | — | 0.5 |
| | Others [1)] | | — | — | — | — | — | 0.1 | — | — | — | — |
| Properties of fresh oil | Kinematic viscosity (40° C.) | $mm^2/s$ | 31.80 | 32.38 | 31.02 | 32.46 | 32.52 | 32.78 | 32.21 | 30.93 | 31.79 | 32.21 |
| | Acid value | mg KOH/g | 0.00 | 0.00 | 0.01 | 0.01 | 0.01 | 0.02 | 0.01 | 0.00 | 0.00 | 0.01 |

TABLE 1-continued

| | | | Examples | | | | | | Comparative Examples | | | |
|---|---|---|---|---|---|---|---|---|---|---|---|---|
| | | | A1 | A2 | A3 | A4 | A5 | A6 | A1 | A2 | A3 | A4 |
| Evaluation results | | | | | | | | | | | | |
| Lubricity test | Shell wear | mm | 0.68 | 0.60 | 0.61 | 0.58 | 0.59 | 0.59 | 0.71 | 0.72 | 0.70 | 0.71 |
| | Shell EP (LWI) | N | 174 | 174 | 174 | 174 | 174 | 174 | 96 | 96 | 96 | 96 |
| Thermal stability test (150° C.; 168 h) | Kinematic viscosity (40° C.) | $mm^2/s$ | 33.38 | 34.20 | 36.21 | 34.15 | 34.18 | 36.44 | 117.51 | 94.10 | 108.60 | 68.70 |
| | Acid value | mg KOH/g | 0.00 | 0.00 | 0.15 | 0.02 | 0.01 | 0.15 | 10.51 | 7.33 | 7.91 | 5.82 |
| | Millipore amount | mg/100 mL | 0.0 | 0.0 | 0.1 | 0.1 | 0.2 | 0.1 | 24.0 | 2.7 | 0.3 | 1.8 |
| Oxidation stability test (165.5° C.; 96 h) | Kinematic viscosity (40° C.) | $mm^2/s$ | 31.88 | 32.57 | 33.41 | 34.67 | 34.55 | 33.41 | 40.62 | 31.49 | 39.72 | 39.72 |
| | Acid value | mg KOH/g | 0.00 | 0.02 | 0.05 | 0.02 | 0.02 | 0.05 | 2.84 | 0.11 | 6.28 | 2.84 |
| | Millipore amount | mg/100 mL | 0.3 | 1.3 | 1.8 | 2.1 | 2.5 | 1.5 | 230 | 2.5 | 3000 | 150 |

Note
1) Rust inhibitor (alkenyl succinic acid ester); metal deactivator (benzotriazole); defoaming agent (dimethyl silicone)

From the results shown in Table 1, it was apparently confirmed that the sample oils of Examples A1 to A6 according to the present invention all were excellent in not only lubricating property (such as wear resistance and load resistance) but also heat resistance and oxidation stability, and further were substantially free from generation of varnishing.

Also, it was confirmed that the sample oil of Example A6 in which the ordinary additives for gas compressors were further compounded well maintained the above respective properties without inhibiting aimed effects of the specific antioxidant as a main component of the lubricating oil composition according to the present invention.

On the other hand, it was confirmed that the sample oils of Comparative Examples A1 to A4 in which merely the ordinary antioxidant such as DBPC and the amine-based antioxidant was compounded and which contained no specific antioxidant according to the present invention, was not only deteriorated in lubricating property, thermal stability and oxidation stability, but also suffered from remarkable generation of varnishing.

Examples B1 to B4 and Comparative Examples B1 and B2

First, the methods for evaluating properties and performances of the lubricating oil compositions obtained in the following Examples and Comparative Examples are explained.

(1) Kinematic Viscosity:
Measured according to JIS K 2283.

(2) Calcium Content and Phosphorus Content:
Measured according to JPI-5S-38-92.

(3) Zinc Content:
Measured according to JPI-5S-38-92.

(4) Sulfur Content:
Measured according to JIS K 2541.

(5) Sulfated Ash Content:
Measured according to JIS K 2272.

(6) Reciprocating Friction Test

Using a reciprocating friction tester, an SUJ-2 plate as a test plate having a hardness (HRC) of 61, a ten-point average surface roughness (Rz) of 0.004 μm and a size of 3.9 mm×38 mm×58 mm and an SUJ-2 ball as a test ball having a diameter of 10 mm were subjected to abrasion test under the following conditions. After completion of the abrasion test, the wear track size of the test ball was measured. The smaller the wear track size of the test ball after completion of the abrasion test, the more excellent the wear resistance becomes.

(Testing Conditions)
Testing Temperature: 100° C.
Load: 200 N
Amplitude: 15 mm
Frequency: 10 Hz
Testing Time: 30 min (7) Hot Tube Test The hot tube test was carried out at a temperature set to 300° C. under the conditions according to JPI-5S-55-99 except for the temperature. The test results were scored according to JPI-5S-55-99, i.e., a lacquer deposited on a test tube was evaluated according to 11 ratings from 0 point (black) to 10 point (colorless) in which the larger the number of the rating point, the smaller the amount of the lacquer deposited becomes, namely the more excellent the high-temperature detergency becomes.

(8) Oxidation Stability Test

According to JIS K 2514-1996, an oxidation stability test for lubricants for internal combustion engines (Indiana Stirring Oxidation Test) was carried out under the following conditions.

(Testing Conditions)
Testing Temperature: 165.5° C.
Rotating Speed: 1300 rpm
Testing Time: 96 h
Catalyst: Copper plate and iron plate After completion of the oxidation stability test, a base number of the lubricating oil and an amount of copper in the oil (amount of copper eluted) were measured. The residual percentage of base number of the oil was calculated according to the following formula. Meanwhile, the larger residual percentage of base number indicates that the oil is more excellent in long drain property, i.e., has long oil replacement intervals. In addition, the larger amount of copper eluted indicates that the oil has a larger adverse influence on copper-containing metal materials, i.e., tends to cause corrosion of metals. Residual percentage of base number (%)=(Base number of lubricating oil composition after the oxidation stability test)/(Base number of lubricating oil composition before the oxidation stability test)×100

The base oils and the additives shown in Table 2 were respectively compounded in the proportions shown in Table 2 to prepare lubricating oil compositions for internal combustion engines. The properties, formulations and performances of the resulting compositions are shown in Table 2.

TABLE 2

| | | | Examples | | | | Comparative Examples | |
|---|---|---|---|---|---|---|---|---|
| | | | B1 | B2 | B3 | B4 | B1 | B2 |
| Formulation (mass %) | Base oil [1] | | 84.29 | 82.55 | 84.59 | 83.10 | 84.95 | 83.73 |
| | Viscosity index improver [2] | | 6.50 | 6.50 | 6.50 | 6.50 | 6.50 | 6.50 |
| | Pour point depressant [3] | | 0.30 | 0.30 | 0.30 | 0.30 | 0.30 | 0.30 |
| | Metallic detergent [4] | | 1.80 | 2.90 | 1.50 | 2.35 | 1.50 | 2.35 |
| | Polybutenyl succinic acid amide [5] | | 5.00 | 5.00 | 5.00 | 5.00 | 5.00 | 5.00 |
| | Phenol-based antioxidant [6] | | 0.50 | 0.50 | 0.50 | 0.50 | 0.50 | 0.50 |
| | Amine-based antioxidant [7] | | 0.50 | 0.50 | 0.50 | 0.50 | 0.50 | 0.50 |
| | Zinc dialkyl dithiophosphate [8] | | — | — | — | — | 0.60 | 0.97 |
| | Phosphorus compound A [9] | | 0.96 | 1.60 | 0.96 | 1.60 | — | — |
| | Metal deactivator [10] | | 0.05 | 0.05 | 0.05 | 0.05 | 0.05 | 0.05 |
| | Defoaming agent [11] | | 0.10 | 0.10 | 0.10 | 0.10 | 0.10 | 0.10 |
| Properties of fresh oil | Base number (mg KOH/g) | | 4.2 | 6.5 | 3.6 | 5.3 | 3.6 | 5.3 |
| | Calcium content (mass %) | | 0.14 | 0.23 | 0.12 | 0.18 | 0.12 | 0.18 |
| | Phosphorus content (mass %) | | 0.05 | 0.08 | 0.05 | 0.08 | 0.05 | 0.08 |
| | Zinc content (mass %) | | 0 | 0 | 0 | 0 | 0.05 | 0.09 |
| | Sulfur content (mass %) | | 0.05 | 0.03 | 0.05 | 0.03 | 0.11 | 0.18 |
| | Sulfated ash content (mass %) | | 0.50 | 0.80 | 0.43 | 0.67 | 0.50 | 0.79 |
| Evaluation results | Reciprocating friction test | Wear track size on test balls (mm) | 0.42 | 0.39 | 0.42 | 0.40 | 0.44 | 0.43 |
| | Hot tube test (300° C.) | Scores | 9.5 | 9.5 | 9.5 | 9.5 | 0 | 0 |
| | Oxidation stability test (165.5° C.; 96 h) | Base number (mg KOH/g) | 1.6 | 3.0 | 1.3 | 2.4 | 0.8 | 1.2 |
| | | (Residual percentage of base number (%)) | (38.1) | (46.2) | (36.1) | (45.3) | (22.2) | (22.6) |
| | | Amount of copper eluted (ppm by mass) | 2 | 4 | 2> | 2> | 36 | 54 |

Note:

[1] Hydrogenated refined oil (kinematic viscosity at 40° C.: 21 $mm^2/s$; kinematic viscosity at 100° C.: 4.5 $mm^2/s$; viscosity index: 127; % $C_A$: 0; sulfur content: less than 20 ppm by mass; NOACK test evaporation amount: 13.3% by mass)

[2] Polymethacrylate (weight-average molecular weight: 420000; resin content: 39% by mass)

[3] Polyalkyl methacrylate (weight-average molecular weight: 6000)

[4] Perbasic calcium salicylate (base number (perchlorate method): 225 mg KOH/g; Ca content: 7.8% by mass; sulfur content: 0.3% by mass)

[5] Average molecular weight of polybutenyl group: 2000; nitrogen content: 0.99% by mass

[6] n-Octadecyl-3-(4-hydroxy-3,5-di-t-butylphenyl)propionate

[7] Dialkyl diphenyl amine (nitrogen content: 4.62% by mass)

[8] Zinc content: 9.0% by mass; phosphorus content: 8.2% by mass; sulfur content: 17.1% by mass; alkyl group: mixture of sec-butyl group and sec-hexyl group

[9] 2,4,8,10-Tetra-t-butyl-6-[3-(3-methyl-4-hydroxy-5-t-butylphenyl)propoxy] dibenzo[d,f][1,3,2]dioxaphosphepine) phosphonate ["Sumilizer GP" (trade-name) available from Sumitomo Chemical Co., Ltd.]

[10] 1-[N,N-bis(2-ethylhexyl)aminomethyl] methyl benzotriazole

[11] Silicone-based defoaming agent

From Table 2, it was confirmed that the lubricating oil compositions for internal combustion engines in which the phosphorus compound A according to the present invention was compounded were excellent in wear resistance, high-temperature detergency and residual percentage of base number even though they had a low phosphorus content (from 0.05 to 0.08% by mass) and a low sulfated ash content (from 0.50 to 0.81% by mass) (Examples B1 to B4).

On the other hand, it was confirmed that the lubricating oil compositions obtained in Comparative Examples B1 and B2 which were prepared by using zinc dialkyl dithiophosphate in place of the phosphorus compound A used in the Examples, changing the amount of the metal-based cleaning agent compounded, and adjusting the phosphorus content and sulfated ash content to substantially the same levels as in the Examples, were considerably deteriorated in high-temperature detergency (scores of ratings in the hot tube test) and residual percentage of base number as compared to those of the lubricating oil compositions obtained in Examples B1 and B2, and also deteriorated in wear resistance. In addition, the lubricating oil compositions obtained in Comparative Examples B1 and B2 had a high sulfur content as compared to the compositions obtained in the Examples.

Industrial Applicability

The lubricating oil composition according to the present invention can be suitably used as a compressor oil for which a continuous long-term operation time is required. Also, the lubricating oil composition according to the present invention can be extensively and effectively used as a lubricating oil composition for internal combustion engines such as gasoline engines, diesel engines and gas engines.

The invention claimed is:

1. A lubricating oil composition comprising a hydrogenated refined mineral base oil that has a % $C_A$ value of 10 or less as measured by ring analysis, a sulfur content of 300 ppm by mass or less and a viscosity index of 70 or more;

0.1 to 3% by mass based on the total composition of a dialkylphenylamine antioxidant selected from the group consisting of 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine; and 0.5 to 2% by mass based on the total composition of a phosphorus compound having a structure represented by the following formula (I):

(I)

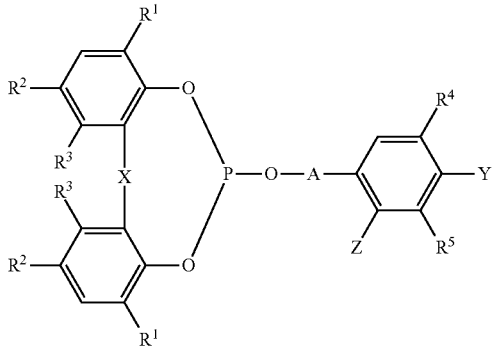

wherein $R^1$, $R^2$, and $R^4$ are each independently an alkyl group having 1 to 8 carbon atoms $R^3$ is a hydrogen atom or a methyl group; $R^5$ is an alkyl group having 1 to 5 carbon atoms; X is a simple bond, A is an alkylene group having 2 to 8 carbon atoms, and one of Y and Z is a hydroxyl group and the other of Y and Z is a hydrogen, wherein the composition has a phosphorus content of 0.12% by mass or less and a sulfated ash content of 1.2% by mass or less on the basis of an amount of the composition.

2. The lubricating oil composition according to claim 1, further comprising at least one additive selected from the group consisting of an ashless dispersant, a metallic detergent, a friction modifier, an extreme-pressure additive, a rust inhibitor, a viscosity index improver, a pour-point depressant, a metal deactivator, a defoaming agent, a demulsifier and a colorant.

3. A gas compressor comprising the lubricating oil composition according to claim 1.

4. An internal combustion engine comprising the lubricating oil composition according to claim 1.

5. The lubricating oil composition according to claim 1, wherein $R^1$ , $R^2$ and $R^4$ are a t-butyl group.

6. The lubricating oil composition according to claim 1, wherein $R^1$ and $R^4$ are independently a t-butyl group or a t-pentyl group.

7. The lubricating oil composition according to claim 1, wherein $R^2$ is an alkyl group having 1 to 5 carbon atoms.

8. The lubricating oil composition according to claim 1, wherein $R^2$ is a methyl group , a t-butyl group or a t-pentyl group.

9. The lubricating oil composition according to claim 1, wherein $R^5$ is a methyl group.

10. The lubricating oil composition according to claim 1, wherein $R^3$ is a hydrogen atom.

11. The lubricating oil composition according to claim 1, which has a sulfur content of 0.10% by mass or less.

12. The lubricating oil composition according to claim 1, wherein A is a propylene group.

13. The lubricating oil compoisiton according to claim 1, wherein the phosphorus compound is 6-[3-(3-t-butyl-4-hydroxy-5-methylphenyl)propoxy]-2,4,8,10-tetra -t-butyldibenzo[d,f][1,3,2]-dioxaphosphepine.

14. The lubricating oil composition according to claim 1, wherein the dialkylphenylamine antioxidant is dioctyldiphenylamine.

15. The lubricating oil composition according to claim 13, wherein the dialkylphenylamine antioxidant is dioctyldiphenylamine.

* * * * *